US006348665B1

(12) United States Patent
Ohashi et al.

(10) Patent No.: US 6,348,665 B1
(45) Date of Patent: Feb. 19, 2002

(54) TILT SWITCH

(75) Inventors: Shigeo Ohashi; Hiroshi Shirai, both of Kawasaki (JP)

(73) Assignee: Nihon Kaiheiki Industrial Company, Ltd. (JP)

( * ) Notice: Subject to any disclaimer, the term of this patent is extended or adjusted under 35 U.S.C. 154(b) by 0 days.

(21) Appl. No.: 09/666,548

(22) Filed: Sep. 21, 2000

(30) Foreign Application Priority Data

Sep. 24, 1999 (JP) ..... 11-270780
Nov. 18, 1999 (JP) ..... 11-327587

(51) Int. Cl.[7] ..... H01H 35/02
(52) U.S. Cl. ..... 200/61.52; 200/61.45 R
(58) Field of Search .. 200/DIG. 29, 61.45 R–61.45 M, 200/61.52

(56) References Cited

U.S. PATENT DOCUMENTS 4,733,324 A * 3/1988 George ..... 361/118

* cited by examiner

*Primary Examiner*—P. Austin Bradley
*Assistant Examiner*—Nhung Nguyen
(74) *Attorney, Agent, or Firm*—Lorusso & Loud

(57) ABSTRACT

A tilt switch includes a pair of contact elements; and at least one ball member which rolls along a path defined between the contact elements. The contact elements are disposed facing each other with a distance therebetween, as measured at one end, which is greater than the diameter of the ball member, and as measured at the other end, which is slightly smaller than the diameter of the ball member. Tilting of the tilt switch is electrically detected through detection of whether or not the ball member is held between the contact elements. In another embodiment the tilt switch includes a housing having a hollow portion; at least one rolling member disposed to roll substantially linearly within the hollow portion; a contact mechanism accommodation portion disposed side by side with the hollow portion; a movable contact element and a stationary contact element accommodated within the contact mechanism accommodation portion and disposed facing each other, each of the movable contact element and the stationary contact element being a spring element; and a working member having a pivot formed thereon. The working member has a portion thereof projecting into the hollow portion and is rotated by movement of the rolling member to press the movable contact element into contact with the stationary contact element.

5 Claims, 14 Drawing Sheets

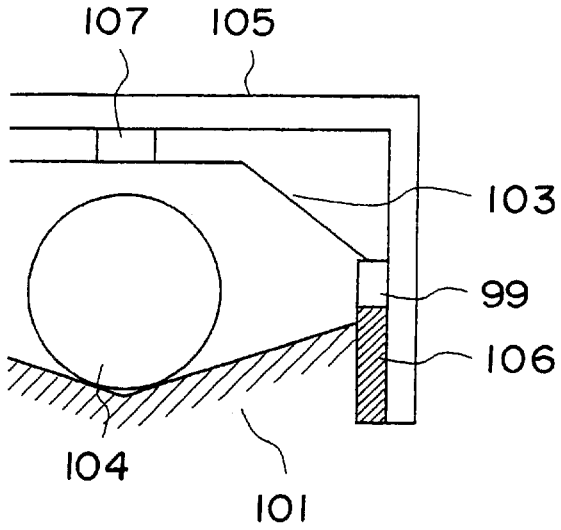
FIG. 19
FIG. 20
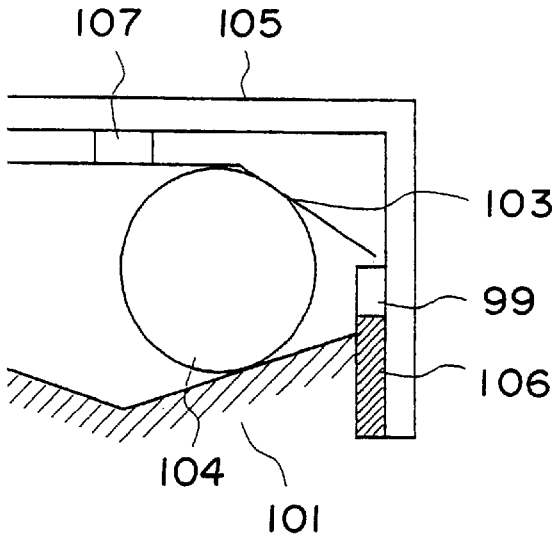

TILT SWITCH

BACKGROUND OF THE INVENTION

1. Field of the Invention

The present invention relates to a tilt switch for controlling current through detection of the tilt of equipment.

2. Description of the Related Art

In contrast to a tumble detection switch, a tilt switch attached to a drive unit for effecting an opening/closing operation of, for example, a crossing gate or kitchen equipment is required to exhibit high switching durability associated with repeated tilting in a certain direction. Examples of such a tilt switch include a mercury switch.

FIG. 1 is a sectional view of a conventional mercury switch serving as a tilt switch.

In FIG. 1, reference numeral 1 denotes a glass container; reference numeral 2 denotes a pair of stationary electrodes fixedly attached to the glass container; and reference numeral 3 denotes mercury enclosed within the glass container 1 and adapted to establish electrical continuity between the paired stationary electrodes 2 upon tilting of the glass container 1.

Such a conventional tilt switch using mercury involves a significant environmental problem, Is subjected to severe governmental regulations, and is not suited for use with equipment handling food, such as kitchen equipment.

FIG. 2 is a sectional view of a conventional tumble-detection-type tilt switch.

In FIG. 2, reference numeral 4 denotes a conductive ball member; reference numeral 5 denotes an electrode which also serves as a housing; reference 6 denotes an electrode which also serves as a holder for holding the ball member 4 at a neutral position; and reference numeral 7 denotes an insulator for insulating the electrodes 5 and 6 from each other.

Such a tumble-detection-type tilt switch involves problems in terms of switching capacity and switching durability.

SUMMARY OF THE INVENTION

An object of the present invention is to solve the above-mentioned problems involved in the conventional tilt switch and to provide an inexpensive tilt switch of excellent durability and low environmental impact.

(1) To achieve the above object, the present invention provides a tilt switch comprising a pair of contact elements, at least one of the contact elements being formed of an elastic member; and at least one ball member which rolls along a path defined between the contact elements. The contact elements are disposed in a facing manner such that the distance therebetween as measured at one end is greater than the diameter of the ball member, whereas the distance therebetween as measured at the other end is slightly smaller than the diameter of the ball member.

Preferably, the contact elements are disposed such that free-end portions thereof approach each other, and the tilt switch further comprises a restriction wall for maintaining a predetermined distance between the free-end portions.

Preferably, each of the contact elements is formed of a wire, and the restriction wall assumes the form of a pair of recess portions or protrusions for restricting movement of free-end portions of the contact elements.

(2) To achieve the above object, the present invention further provides a tilt switch comprising a housing having a hollow portion of a substantially columnar or cubic shape; at least one rolling member disposed in such a manner as to roll substantially linearly within the hollow portion; a contact mechanism accommodation portion disposed side by side with the hollow portion; a movable contact element and a stationary contact element accommodated within the contact mechanism accommodation portion and disposed in a facing manner, each of the movable contact element and the stationary contact element being formed of a spring element; and a working member having a pivot formed thereon, the working member being disposed in such a manner as to rotate as a result of movement of the rolling member and such that a portion thereof projects into the hollow portion.

Preferably, the stationary contact element is supported at a predetermined position by a stopper portion so as to maintain a predetermined distance away from the movable contact element. Preferably, the working member is disposed in such a manner as to project into the hollow portion while forming an obtuse angle with respect to a side wall of the hollow portion.

BRIEF DESCRIPTION OF THE DRAWINGS

FIG. 19 is a sectional view showing a main portion of the tilt switch of the fifth embodiment of FIG. 18 (OFF state);

FIG. 20 is a sectional view showing a main portion of the tilt switch of the fifth embodiment of FIG. 18 (ON state);

DESCRIPTION OF THE PREFERRED EMBODIMENTS

A tilt switch according to the present invention assumes a very simple structure. Specifically, a pair of contact elements are disposed while the distance therebetween is varied, and a ball member rolls along a path defined between the contact elements upon tilting of a switch body, thereby closing and opening connection between the contact elements. Since the contact elements and the ball member are in a sliding-contact relationship, the tilt switch can maintain stable contact therebetween and can be manufactured at low cost while providing excellent quality and assuming a compact size.

According to the present invention, a tilt switch can provide a relatively large switching capacity and excellent durability through employment of the following configuration. Movement of a rolling member causes rotation of a working member having a pivot, thereby bringing into mutual contact spring members disposed in a facing manner. Thus, the weight of the rolling member is transmitted smoothly to the spring members to thereby produce stable contact force.

Embodiments of the present invention will next be described in detail with reference to the drawings.

Figure 3:
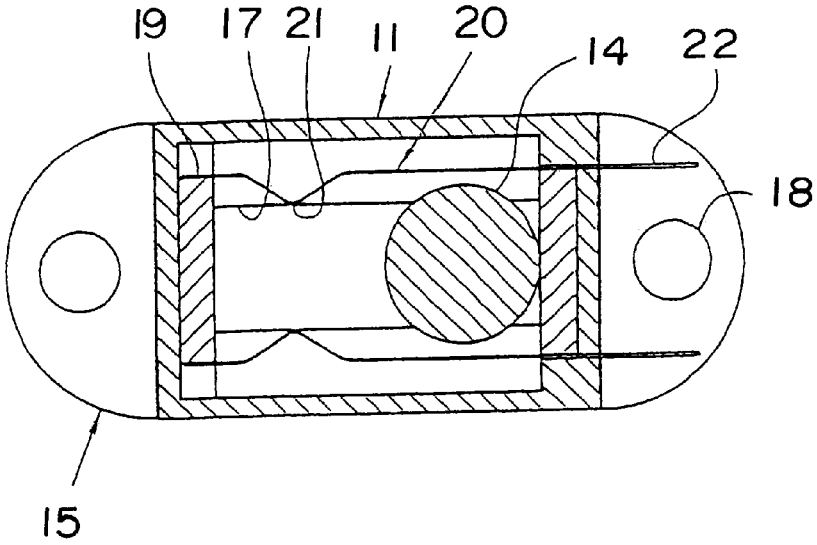
FIG. 3 is a sectional plan view showing a tilt switch according to a first embodiment of the present invention (OFF state)
Figure 4:
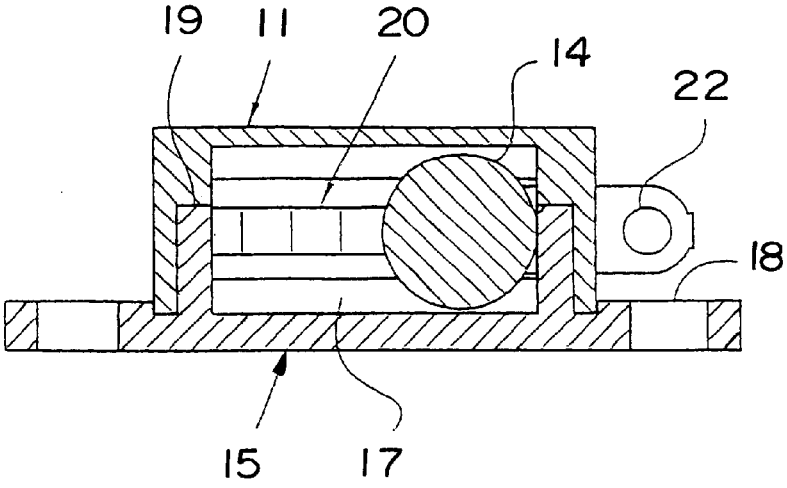
FIG. 4 is a sectional front view of the tilt switch of the first embodiment shown in FIG. 3.
Figure 5:
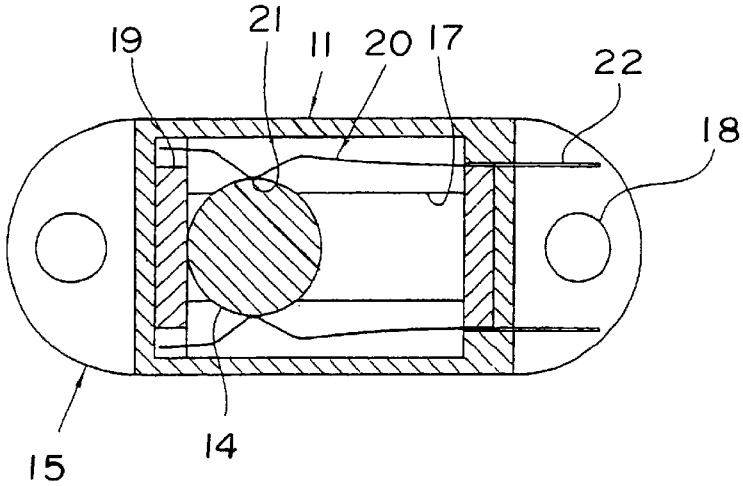
FIG. 5 is a sectional plan view showing the tilt switch of the first embodiment (ON state)
Figure 6:
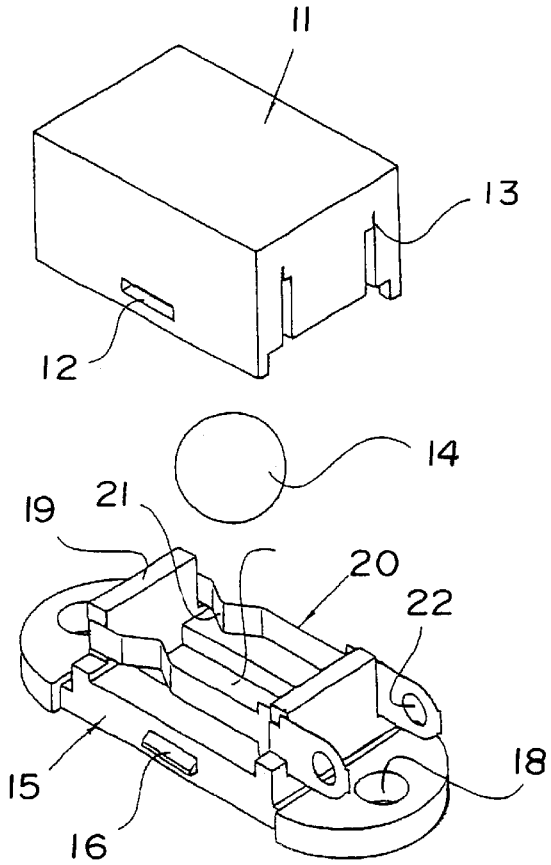
FIG. 6 is an exploded perspective view of the tilt switch of the first embodiment.

FIG. 3 is a sectional plan view showing a tilt switch according to a first embodiment of the present invention (OFF state). FIG. 4 is a sectional front view of the tilt switch of the first embodiment. FIG. 5 is a sectional plan view showing the tilt switch of the first embodiment in an ON state. FIG. 6 is an exploded perspective view of the tilt switch of the first embodiment.

The tilt switch of the first embodiment includes a ball member 14; a base 15; a cover 11; and a pair of contact elements 20. The ball member 14 is conductive and can roll freely. The base 15 has a groove portion 17, along which the ball member 14 rolls linearly. The cover 11 and the base 15 are engaged through engagement of an engagement recess 12 and an engagement protrusion 16 in such a manner as to enclose the ball member 14. The paired contact elements 20 are made of the respective elastic members and are fixedly held between the base 15 and the cover 11 in such a manner as to be disposed in a facing manner while the locus of rolling of the ball member 14 extends substantially along the centerline therebetween. Reference numeral 13 denotes a holder portion; reference numeral 18 denotes a mounting hole; and reference numeral 22 denotes a terminal portion.

One end of each of the contact elements 20 is formed into the terminal portion 22, whereas a restriction wall 19 projecting from the base 15 prevents the other ends of the contact elements 20 from approaching beyond a certain extent.

The contact elements 20 are disposed such that the distance therebetween is slightly greater than the diameter of the ball member 14 as measured in the vicinity of the terminal portions 22 and such that the distance therebetween is slightly less than the diameter of the ball member 14 as measured at contact portions 21 located in the vicinity of the restriction wall.

The restriction wall 19 restricts the distance between the free-end portions of the contact elements 20 to thereby maintain the distance between the contact portions 21 at high accuracy, whereby the force of contact between the ball member 14 and the contact portions 21 can be maintained at a constant level.

That is, the contact elements 20 are disposed in such a manner as to hold the restriction wall 19 from opposite sides, thereby preventing the distance between the contact portions 21 from becoming too long, which would cause poor contact between the ball member 14 and the contact portions 21, and preventing the distance from becoming too short, which would hinder movement of the ball member 14. Thus, the accuracy of the distance between the contact elements 20 can be improved greatly, thereby imparting good quality to the tilt switch.

Figure 7:
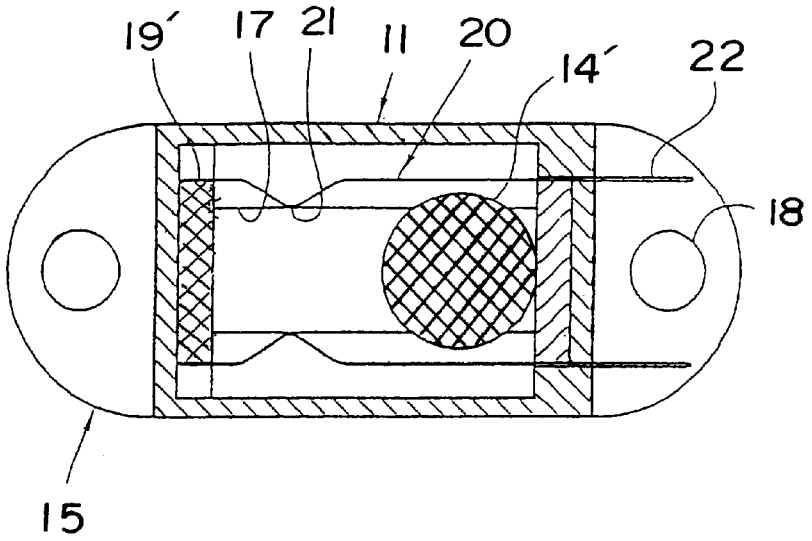
FIG. 7 is a sectional plan view showing a tilt switch according to a modification of the first embodiment of the present invention (ON state)
Figure 8:
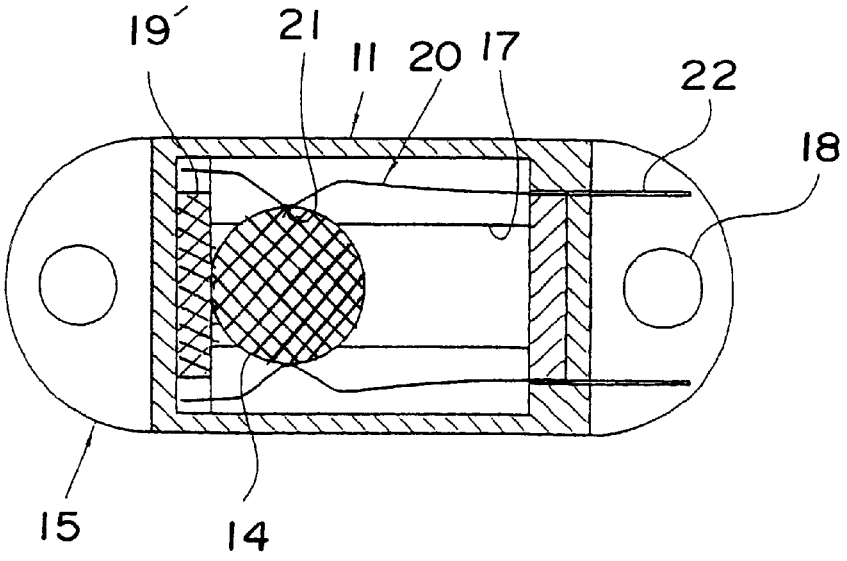
FIG. 8 is a sectional plan view showing the tilt switch according to the modification of the first embodiment (OFF state)

Next, a tilt switch according to a modification of the first embodiment of the present invention will be described with reference to FIGS. 7 and 8.

In the present modification, the restriction wall 19 shown in FIGS. 3 to 6 is replaced with a conductive restriction wall 19', and a ball member 14' made of an insulating material is used. In a state shown in FIG. 7, electrical continuity is established between the contact elements 20 by means of the restriction wall 19', so that the tilt switch enters the ON state. When as shown in FIG. 8 the ball member 14' rolls to the contact portions 21 upon tilting of the tilt switch, the end portions of the contact elements 20 move away from the conductive restriction wall 19', so that the tilt switch enters the OFF state. That is, in the present modified embodiment, the on-off mode of the tilt switch is opposite that of the tilt switch of the first embodiment shown in FIGS. 3 to 6.

Figure 9:
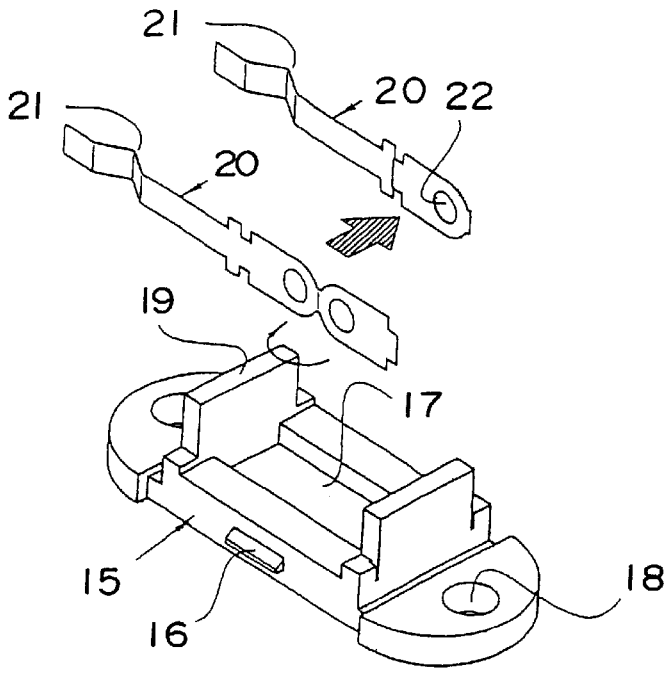
FIG. 9 is a perspective partial view showing formation of a terminal portion of the tilt switch of the first embodiment.

FIG. 9 is a perspective partial view showing formation of the terminal portion of the tilt switch of the first embodiment. In order to avoid influence on rolling of the ball member 14 (not shown), the contact element 20 is formed of a thin sheet. The terminal portion 22 of the contact element 20 assumes a twofold structure. Reference numeral 21 denotes a contact portion.

Figure 1:
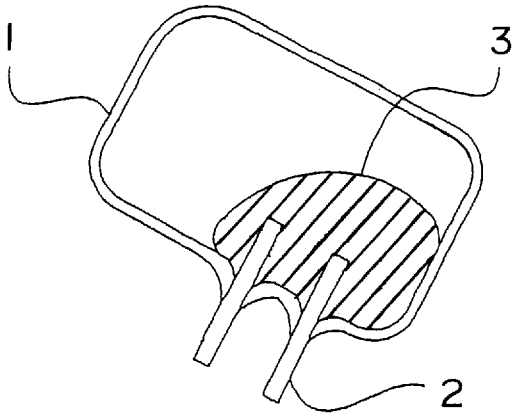
FIG. 1 PRIOR ART
FIG. 1 is a sectional view of a conventional mercury switch.
Figure 2:
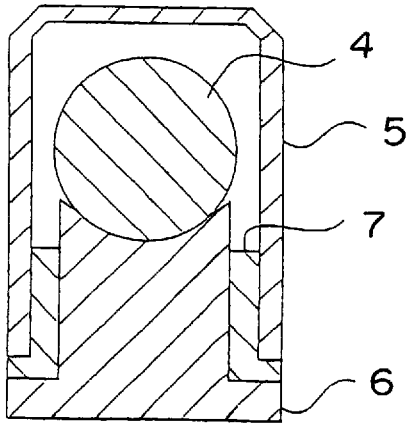
FIG. 2 PRIOR ART
FIG. 2 is a sectional view of a conventional tumble-detection-type tilt switch.

As compared with a conventional tilt switch (FIG. 2) which utilizes the weight of a ball member for making contact, the tilt switch of the first embodiment allows flow of a greater current and provides a larger switching capacity. Furthermore, a contact operation is stable and involves little chattering.

By virtue of simple and compact structure, the tilt switch can be inexpensive and robust.

Figure 10:
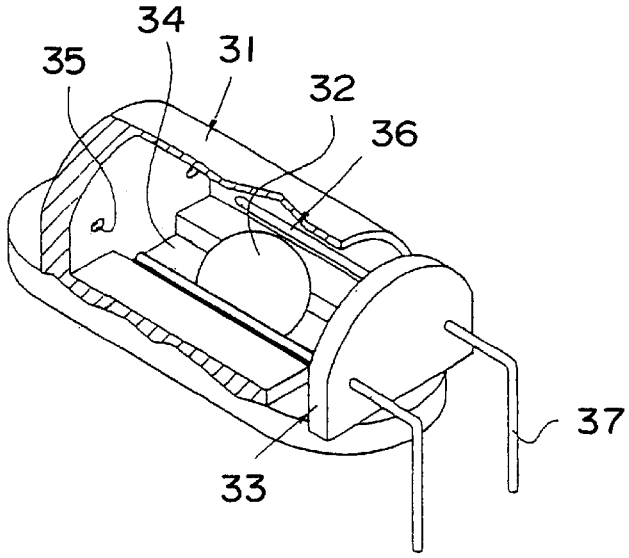
FIG. 10 is a sectioned perspective view showing a tilt switch according to a second embodiment of the present invention.

FIG. 10 is a perspective view showing a tilt switch according to a second embodiment of the present invention with a partially cutaway view of a base 33. In the present embodiment, each of paired contact elements 36 is formed of a wire, and two elliptic recess portions 35, which function in a manner similar to that of the restriction wall of the first embodiment, are formed on the base 33. The form of the recess portion 35 is not particularly limited. For example, the recess portion 35 may assume the form of a protrusion having a recess formed therein.

Since the contact elements 36 are each formed of a wire, the tilt switch of the present embodiment has the following features: a resistive force against movement of a ball member 32 is reduced; sensitivity to tilting is improved; hermetic seal is enhanced; and reliability of contact is enhanced. Reference numeral 31 denotes a cover; reference numeral 34 denotes a groove portion; and reference numeral 37 denotes a terminal portion.

Accordingly, the tilt switch of the present embodiment can be configured in the following manner. An electrically insulating liquid and the ball member 32 serving as a floating member are enclosed within the hermetically sealed interior of the tilt switch. Buoyancy of the floating member is utilized for opening/closing connection between the contact elements 36.

The ball member 32 serving as a floating member may be hollowed so as to increase buoyance thereof.

The terminal portion 37 is formed for use with a printed circuit board. However, the form of the terminal portion 37 is not limited thereto.

Figure 11:
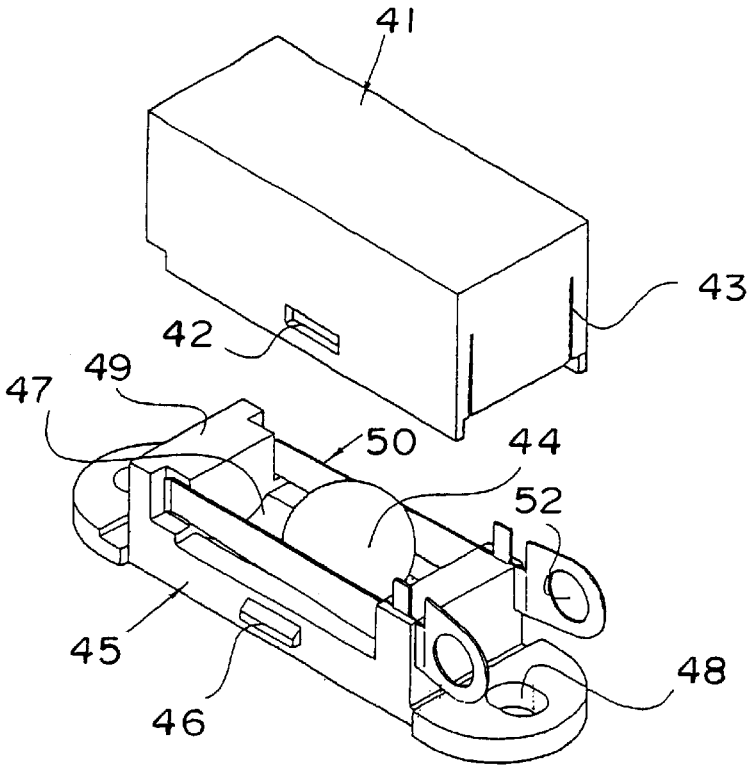
FIG. 11 is a partially exploded perspective view showing a modification the second embodiment of a tilt switch of the present invention.
Figure 12:
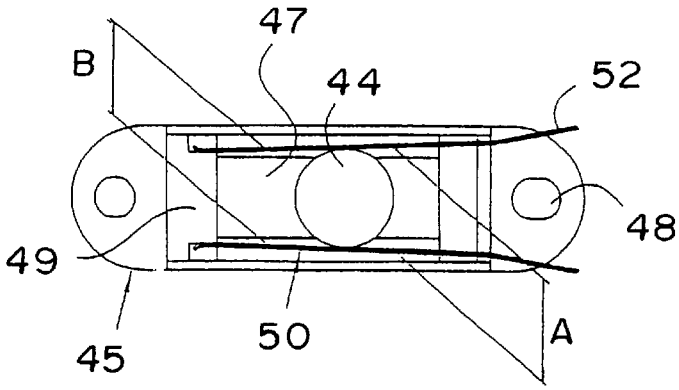
FIG. 12 is a plan view of the tilt switch of FIG. 11.

FIG. 11 is a partially exploded perspective view showing a modification of the second embodiment of the tilt switch of the present invention. FIG. 12 is a plan view of the tilt switch of FIG. 11. In the present modified embodiment, two substantially straight contact elements 50 are disposed in a taperingly facing manner such that distance A between the contact elements 50 as measured on the OFF side is slightly greater than the diameter of a ball member 44, whereas distance B between the contact elements 50 as measured on the ON side is slightly smaller than the diameter of the ball member 44. Reference numeral 41 denotes a cover; reference numeral 42 denotes an engagement recess; reference numeral 43 denotes a holder portion; reference numeral 45 denotes a base; reference numeral 46 denotes an engagement protrusion; reference numeral 47 denotes a groove portion; reference numeral 48 denotes a mounting hole; reference numeral 49 denotes a restriction wall; and reference numeral 52 denotes a terminal portion.

Figure 13:
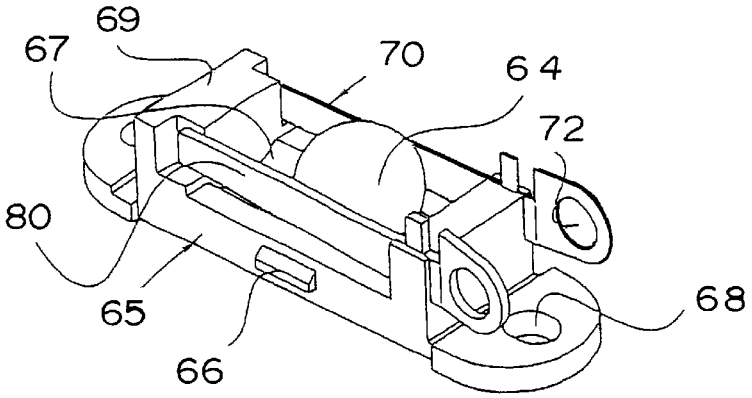
FIG. 13 is a view showing a modification of the second embodiment of a tilt switch in which one of two contact elements is substantially rigid.

FIG. 13 shows a modification of the second embodiment of the tilt switch in which one of two contact elements is substantially rigid.

In FIG. 13, reference numeral 64 denotes a ball member; reference numeral 65 denotes a base; reference numeral 66 denotes an engagement protrusion; reference numeral 67 denotes a groove portion; reference numeral 68 denotes a mounting hole; reference numeral 69 denotes a restriction wall; reference numeral 70 denotes a contact element (sheet element); reference numeral 72 denotes a terminal portion; and reference numeral 80 denotes a substantially rigid contact element.

Figure 14:
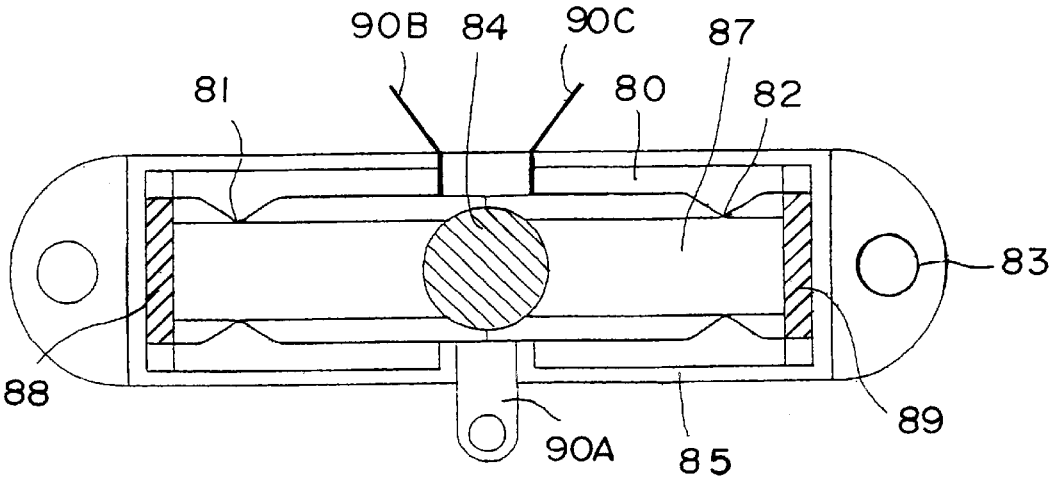
FIG. 14 is a sectional plan view showing a tilt switch according to a third embodiment of the present invention.
Figure 15:
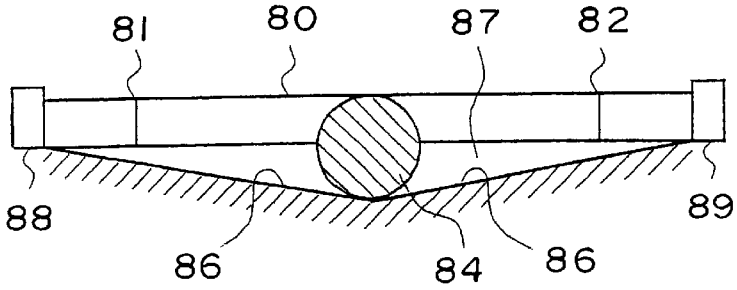
FIG. 15 is a sectional view showing a main portion of the tilt switch of the third embodiment of FIG. 14.

FIG. 14 is a sectional plan view showing a tilt switch according to a third embodiment of the present invention. FIG. 15 is a sectional view showing a main portion of the tilt switch of the third embodiment.

In FIGS. 14 and 15, reference numeral 80 denotes a contact element having left-hand and right-hand contact portions 81 and 82. Reference numeral 83 denotes a mounting hole; reference numeral 84 denotes a ball member; and a reference numeral 85 denotes a base. A groove portion 87 is formed on the base 85 such that a bottom thereof assumes the form of a slope 86 ascending right and left from the center thereof. Reference numerals 88 and 89 denote left-hand and right-hand restriction walls; reference numeral 90A denotes a common terminal; reference numeral 90B denotes a first terminal; and reference numeral 90C denotes a second terminal.

In the tilt switch of the present embodiment, the ball member 84 moves right and left. When the tilt switch is in a horizontal position, the ball member 84 is located at a lowest central portion of the bottom of the groove portion 87. In this state, an electric circuit is opened. When the ball member 84 comes into contact with the contact portions 81 upon leftward tilting of the tilt switch, the electric circuit is closed such that connection between the common terminal 90A and the first terminal 90B is closed. When the ball member 84 comes into contact with the contact portions 82 upon rightward tilting of the tilt switch, the electric circuit is closed such that connection between the common terminal 90A and the second terminal 90C is closed.

The tilt switch of the present embodiment can operate appropriately upon either leftward or rightward tilting thereof. When the tilt switch is in an OFF state, the ball member 84 is stably situated at a central portion thereof; i.e., the OFF state can be maintained stably.

Figure 16:
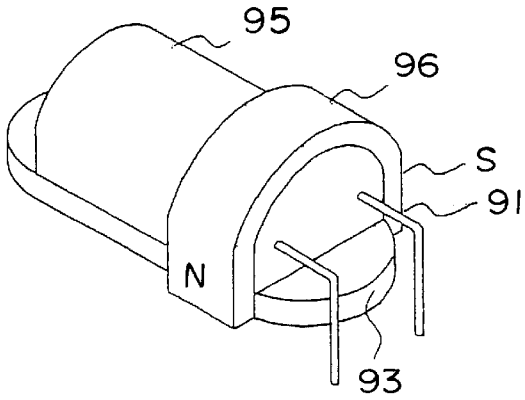
FIG. 16 is a perspective view showing a tilt switch according to a fourth embodiment of the present invention.
Figure 17:
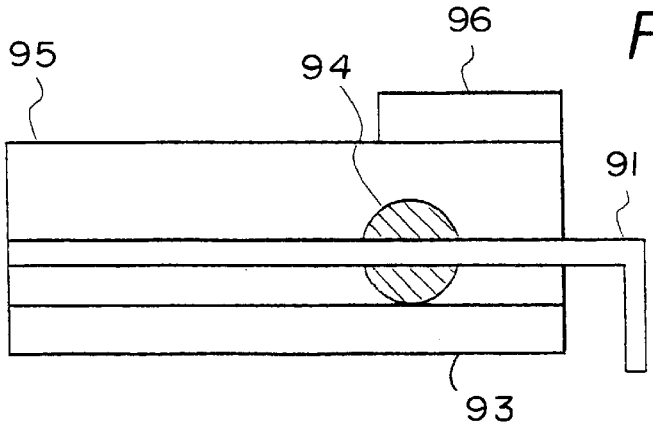
FIG. 17 is a sectional view showing a main portion of the tilt switch of the fourth embodiment of FIG. 16.

FIG. 16 is a perspective view showing a tilt switch according to a fourth embodiment of the present invention. FIG. 17 is a sectional view showing a main portion of the tilt switch of the fourth embodiment.

In FIGS. 16 and 17, reference numeral 91 denotes a contact element; reference numeral 93 denotes a base; reference numeral 94 denotes a ball member; reference numeral 95 denotes a cover; and reference numeral 96 denotes a magnet for holding the ball member 94 in place at one side of the base 93.

In the present embodiment, the ball member 94 is held in place at one side of the base 93 by means of magnetic force of the magnet 96. The ball member 94 is made of material attracted by magnetism.

When the tilt switch is in a horizontal position, the ball member 94 is biased to one side of the base 93 through attraction to the magnet 96. Upon tilting of the tilt switch, the ball member 94 moves against the attractive force of the magnet 96 and contacts the two contact elements 91 at a position where the distance between the contact elements 91 is less than the diameter of the ball member 94, thereby closing the tilt switch.

The angle of tilt for switch operation can be varied. Also, the tilt switch can be designed to cope with vibration, impact, or similar external disturbances. Through employment of the magnet 96, the switching operation of the tilt switch can be controlled freely.

Figure 18:
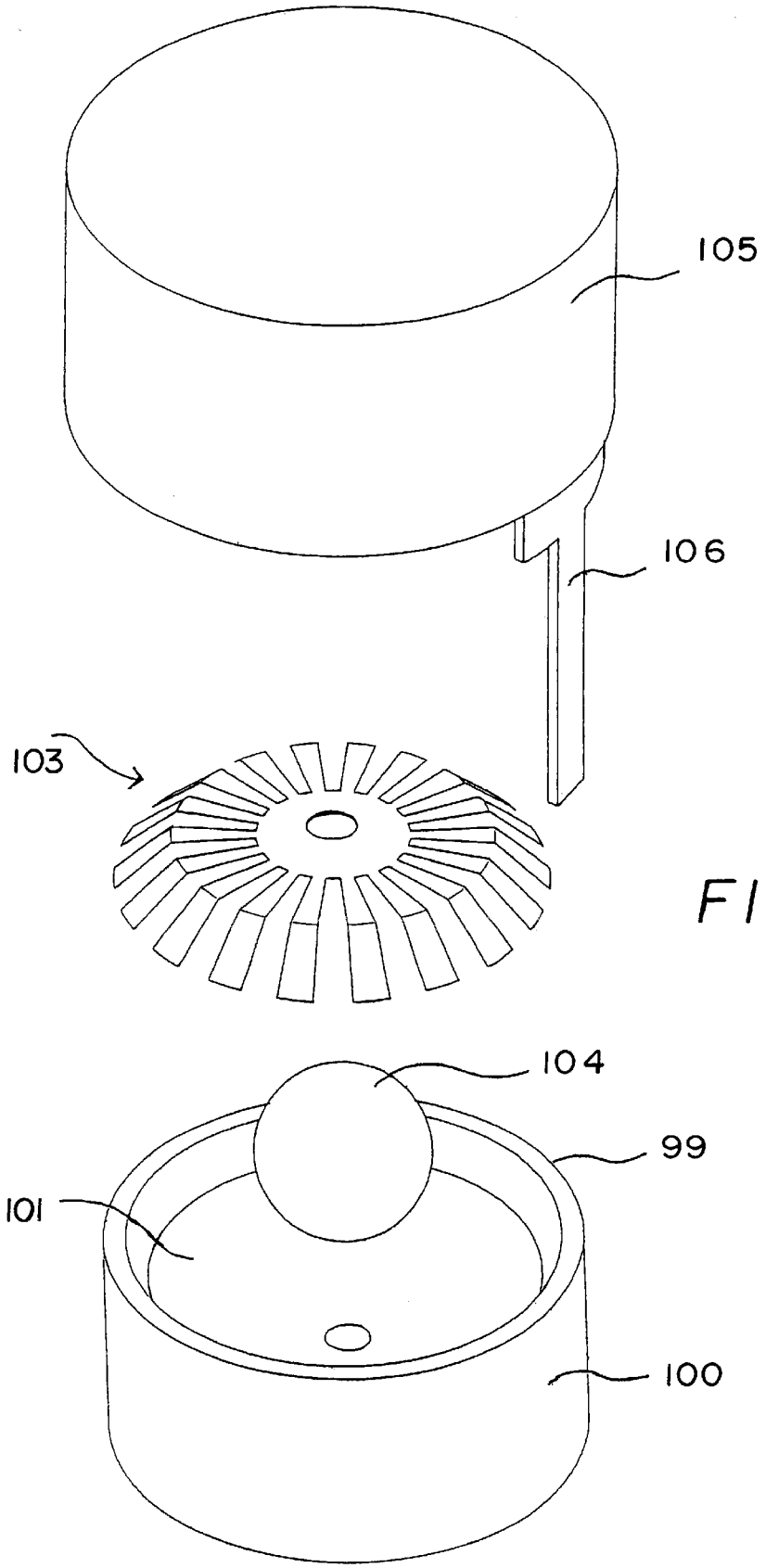
FIG. 18 is an exploded perspective view showing a tilt switch according to a fifth embodiment of the present invention.

FIG. 18 is an exploded perspective view showing a tilt switch according to a fifth embodiment of the present invention. FIG. 19 is a sectional view showing a main portion of the tilt switch of the fifth embodiment in an OFF state. FIG. 20 is a sectional view showing a main portion of the tilt switch of the fifth embodiment in an ON state.

In FIGS. 18 to 20, reference numeral 99 denotes an insulating restriction wall; reference numeral 100 denote a cylindrical insulating base; and reference numeral 101 denotes a conductive bottom of the base 100. The bottom 101 descends toward a central portion thereof, thereby assuming the form of a funnel. Reference numeral 102 denotes a first terminal attached to a central portion of the bottom 101. The first terminal 102 is electrically connected to the conductive bottom 101. Reference numeral 103 denotes a contact element assuming the form of an umbrella frame; reference numeral 104 denotes a conductive ball member; reference numeral 105 denotes a conductive casing; reference numeral 106 denotes a second terminal fixedly attached to the casing 105; and reference numeral 107 denotes a retainer for electrically connecting the contact element 103 and the casing 105. The center portion of the contact element 103 is fixed to the casing 105.

When the ball member 104 is situated at a central portion of the bottom 101, the ball member 104 is separated from the contact element 103, so that an electric circuit is opened. The ball member 104 is held stably at a lowest central portion of the bottom 101. When the tilt switch is tilted, for example, rightward, the ball member 104 moves rightward and comes into contact with the contact element 103. Thus, the electric circuit is closed, thereby establishing the following connection: first terminal 102—bottom 101—ball member 104—contact element 103—retainer 107—casing 105—second terminal 106.

The tilt switch of the present embodiment can detect tilting thereof in any direction, thereby closing/opening the electric circuit accordingly.

Figure 21:
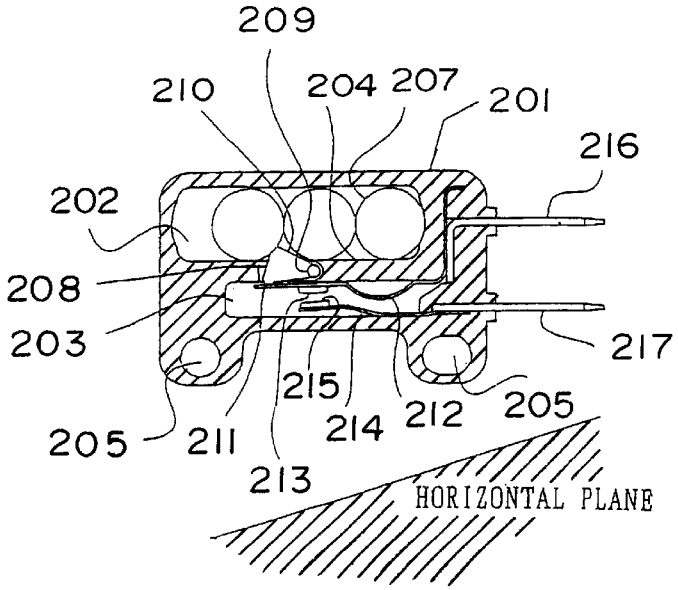
FIG. 21 is a sectional front view showing a tilt switch according to a sixth embodiment of the present invention (tilted clockwise)
Figure 22:
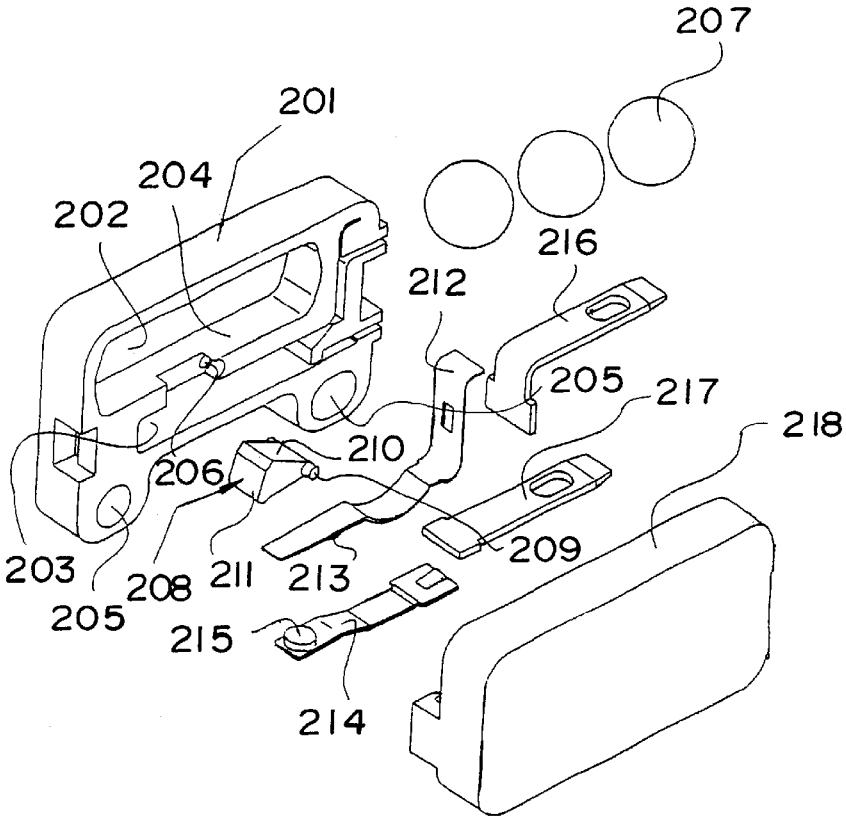
FIG. 22 is an exploded perspective view of the tilt switch of the sixth embodiment.
Figure 23:
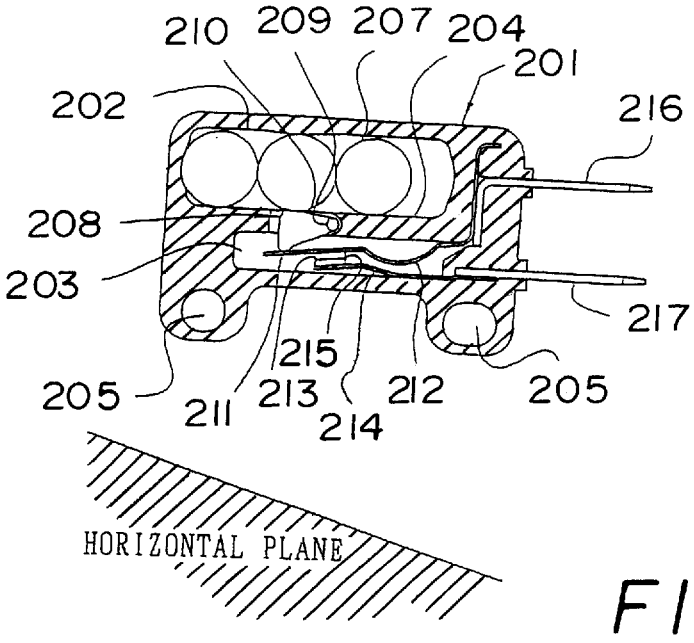
FIG. 23 is a sectional front view showing the tilt switch of the sixth embodiment (tilted counterclockwise)

FIG. 21 is a sectional front view showing a tilt switch according to a sixth embodiment of the present invention and tilted clockwise. FIG. 22 is an exploded perspective view of the tilt switch of the sixth embodiment. FIG. 23 is a sectional front view showing the tilt switch of the sixth embodiment tilted counterclockwise.

The tilt switch of the sixth embodiment includes a half-housing 201; a half-housing 218; three ball members 207 serving as rolling members; a movable contact element 212 assuming the form of a leaf spring; and a stationary contact element 214 assuming the form of a leaf spring. The half-housing 201 and the half-housing 218 each have an elongated hollow portion 202 and a contact mechanism accommodation portion 203 formed therein such that the hollow portion 202 and the contact mechanism accommodation portion 203 extend in parallel with each other while being separated by a partition wall 204. The hollow portion 202 accommodates the ball members 207. The contact mechanism accommodation portion 203 accommodates the movable contact element 212 and the stationary contact element 214 such that the movable contact element 212 and the stationary contact element 214 are disposed facing each other while being held in a cantilever manner.

A movable contact 213 is welded to a substantially intermediate portion of the movable contact element 212, and a stationary contact 215 is welded to a free-end portion of the stationary contact element 214, thereby forming a contact mechanism of a relatively large switching capacity.

Terminals 216 and 217 are disposed in such a manner as to project to the exterior of the housing. A stationary end portion of the movable contact element 212 is brought in elastic contact with the male blade 216 through utilization of elasticity of the movable contact element 212. A stationary end portion of the stationary contact element 214 is brought in elastic contact with the male blade 217 through utilization of elasticity of the stationary contact element 214.

A working member 208 having a pivot 209 is disposed rotatably between the hollow portion 202 and the contact mechanism accommodation portion 203 while the pivot 209 is fitted into the partition wall 204.

One side 210 of the working member 208 is projected into the hollow portion 202 such that an obtuse angle is formed a side wall of the hollow portion 202. A press portion 211 is formed on the other side of the working member 208 and abuts the movable contact element 212. As the working member 208 rotates, the press portion 211 presses the movable contact element 212 so as to bring the movable contact element 212 into contact with the stationary contact element 214 through contact between the respective contacts 213 and 215.

In the present embodiment, the three ball members 207 are accommodated within the hollow portion 202. The ball members 207 located at the end positions play a role of auxiliary weights when the tilt switch is turned on or off. The number of the ball members 207 can be increased or decreased according to working conditions of the tilt switch.

Specifically, when the pressure of contact must be increased in order to increase switching capacity, the number of the ball members 207 is increased. By contrast, when required switching capacity is of a signal detection level, merely a single ball member 207 may be employed.

Figure 24:
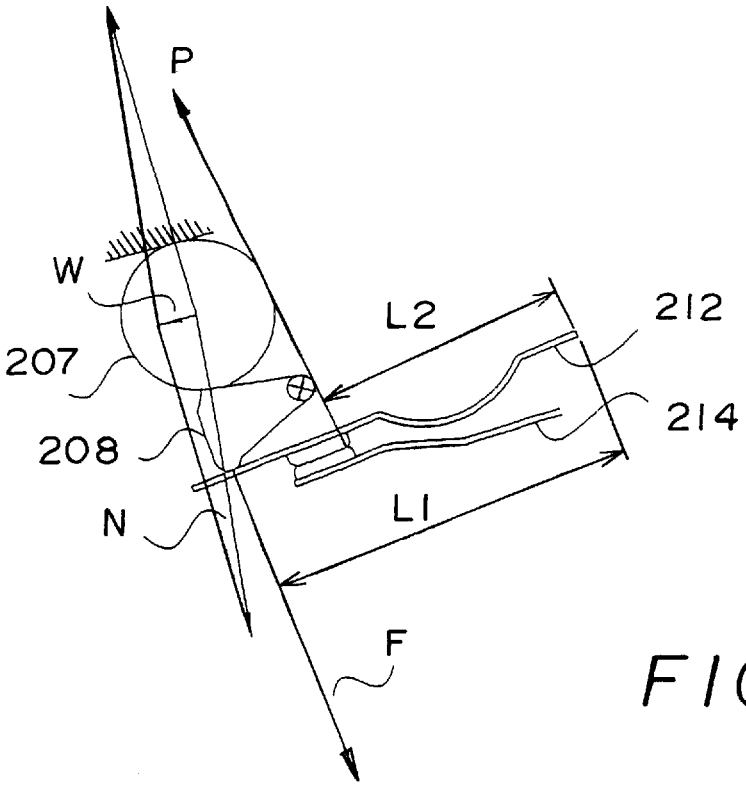
FIG. 24 is a moment diagram associated with a main portion of the tilt switch of the sixth embodiment.

FIG. 24 is a moment diagram associated with essential components of the tilt switch of the sixth embodiment as depicted when the tilt switch is tilted about 30 degrees counterclockwise.

Component W of a force generated from the weight of the ball member 207 as directed along the axis of movement of the ball member 207 causes a vector of pressing force N to be imposed on the working member 208. Notably, since the ball member 207 is wedged between the upper wall of the hollow portion 202 and the working member 208, the pressing force N is large. The pressing force N causes the working member 208 to transmit a pressing moment F to a free-end portion of the movable contact element 212. Due to the positional relationship between a point at which the movable contact element 212 receives force from the working member 208 and a point at which the movable contact element 212 comes into contact with the stationary contact element 214, the relation $P \equiv F(L1/L2)$ holds, where P is the force of contact. Thus, by virtue of the force of contact P, which is far greater than the weight of the ball member 207, stable contact can be maintained, and a large switching capacity can be obtained.

Since the hollow portion 202, which serves as a space for movement of the ball members 207, and the contact mechanism accommodation portion 203 are disposed in parallel, a long lever portion of the movable contact element 212 can be formed without need to increase the size of the tilt switch, thereby utilizing effect of moment.

Furthermore, the pivot 209 of the working member 208 enables transmission of a rotation moment which is imposed on the working member 208 by the ball member 207, to the movable contact element 212 without attenuation. The pivot 209 also enables smooth return of the working member 208 to its neutral position when the tilt switch is restored to a horizontal position.

Figure 25:
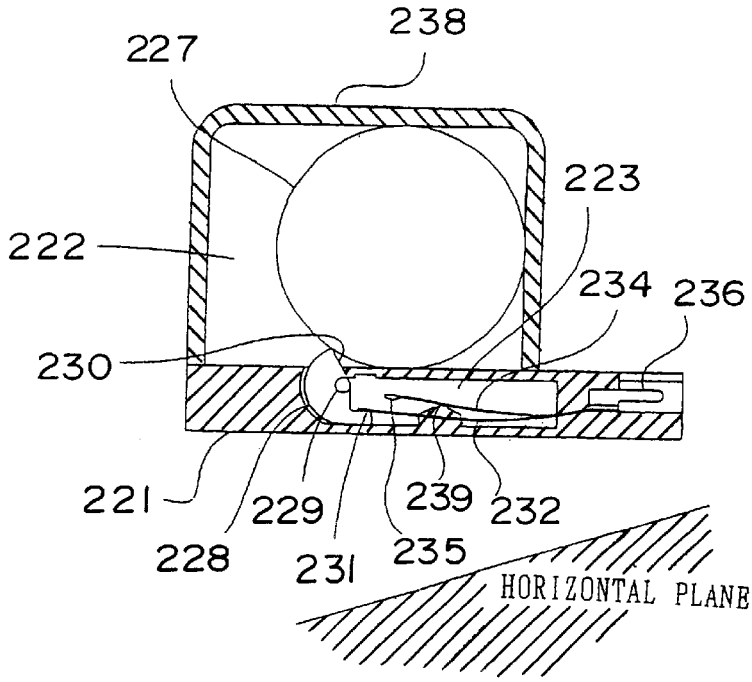
FIG. 25 is a sectional front view showing a tilt switch according to a seventh embodiment of the present invention (tilted clockwise)
Figure 26:
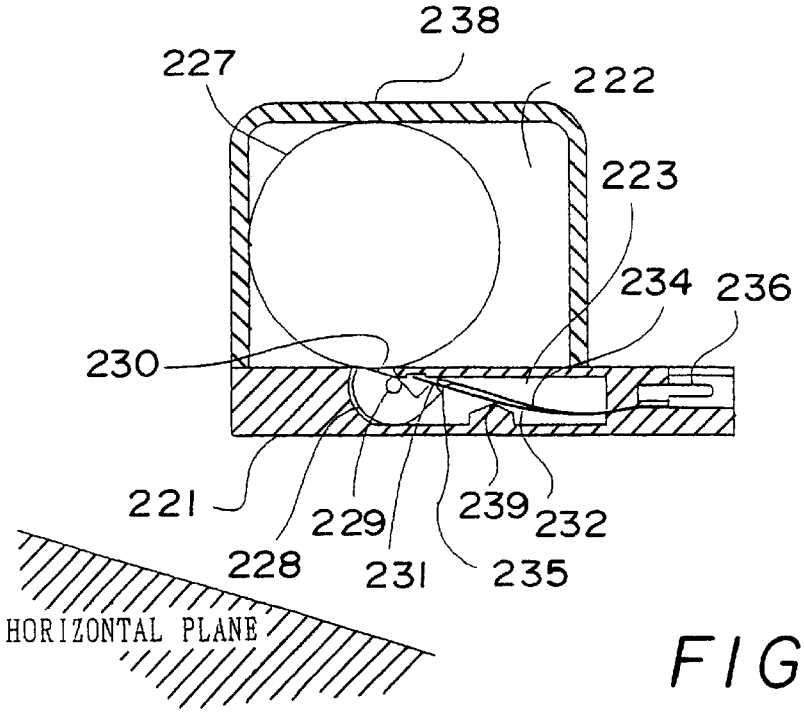
FIG. 26 is a sectional front view showing the tilt switch of the seventh embodiment (tilted counterclockwise)
Figure 27:
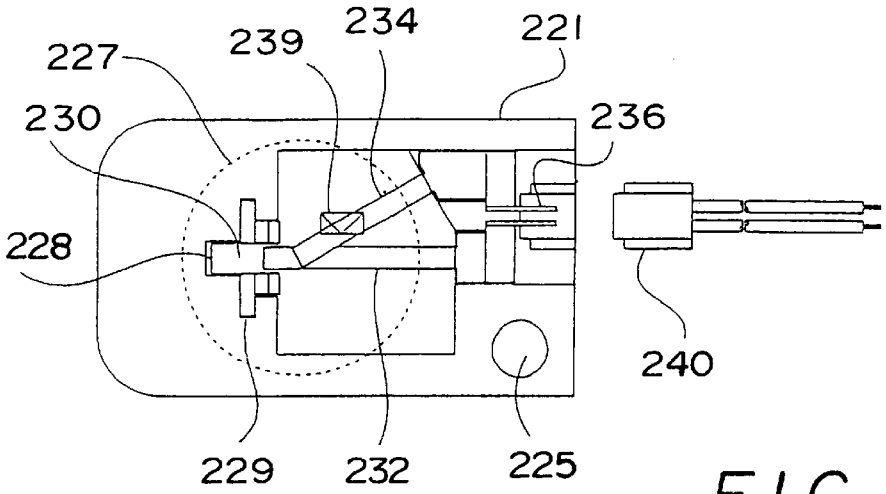
FIG. 27 is a plan view showing the tilt switch of the seventh embodiment.

FIG. 25 is a sectional front view showing a tilt switch according to a seventh embodiment of the present invention and tilted clockwise. FIG. 26 is a sectional front view showing the tilt switch of the seventh embodiment tilted counterclockwise. FIG. 27 is a plan view showing the tilt switch of the seventh embodiment.

The seventh embodiment differs from the sixth embodiment as follows. Merely a single ball member 227 is employed. A connector 240 is employed for external connection. A stationary contact element 234 and a movable contact element 232 are arranged in a manner different from that of the sixth embodiment.

Specifically, the stationary contact element 234 and the movable contact element 232 are disposed within a contact mechanism accommodation portion 223 such that merely contact portions and their adjacent portions face each other in a crossing manner and such that a stopper 239 projecting from a base 221 supports a predetermined position of the stationary contact element 234 so as to establish a predetermined distance therebetween. A free-end portion of the stationary contact element 234 is bent so as to form a pointed contact portion.

Through employment of the above-described configuration, space required for the contact mechanism accommodation portion 223 can be reduced to thereby provide a tilt switch of compact size, and dimensional variations in bending process of the stationary contact element 234 can be absorbed to thereby provide a tilt switch of good accuracy of operation.

The tilt switch of the seventh embodiment is intended for application of very small rating. Since, the amount of wiping after contacts are mated can be sufficiently large, high contact reliability can be maintained.

Figure 28:
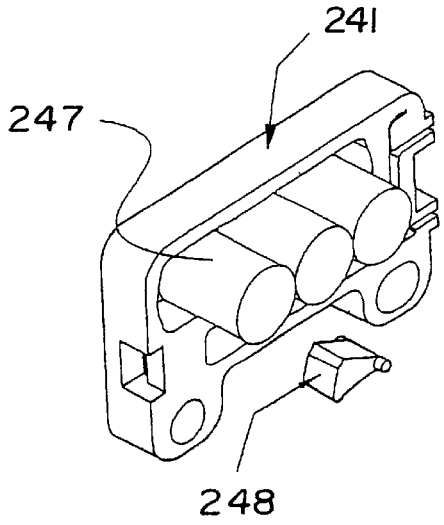
FIG. 28 is a perspective view showing a modification of the rolling member for use in a tilt switch of the present invention.

FIG. 28 is a perspective view showing a modified embodiment of a rolling member for use in a tilt switch of the present invention. The rolling member assumes the form of a circular cylinder 247 instead of the form of a ball. However, the present invention is not limited thereto. For example, the rolling member assumes the form of a barrel (not shown). Alternatively, a circular cylinder having a guide groove formed therein is used in such a manner as to roll along a rail disposed projectingly within the hollow portion through engagement of the groove and the rail (not shown). Reference numeral 241 denotes a half-housing, and reference numeral 248 denotes a working member.

Figure 29:
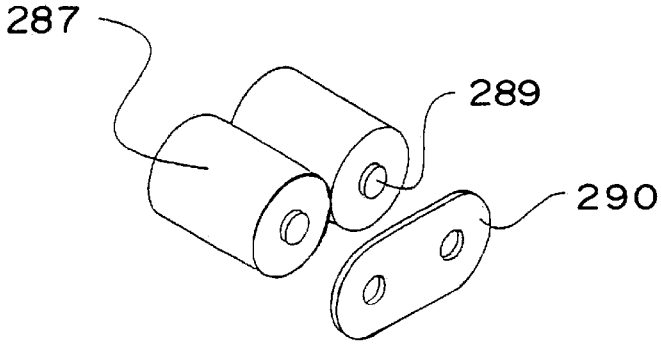
FIG. 29 is a perspective view showing a main portion of a tilt switch according to an eighth embodiment of the present invention.

FIG. 29 is a perspective view showing a main portion of a tilt switch according to an eighth embodiment of the present invention. A rotational shaft 289 is formed on each of rolling members 287. The rolling members 287 are connected in such a manner as to roll together, by means of a connection plate 290. Connection means for connecting rolling members is not particularly limited. For example, magnetism may be imparted to the rolling members so as to cause joined rolling of the rolling members.

When the rolling members 287 are connected so as to roll together, the total of components of force directed in a moving direction of all the rolling members 287 can be transmitted to a working member. Thus, as compared with the case in which the rolling members 287 are not connected, the size of a tilt switch can be rendered more compact. Also, connection between contacts can be opened and closed more reliably, and the force of contact can be enhanced.

Numerous modifications and variations of the present invention are possible with respect to, for example, configuration of contact elements and terminal portions, posture for mounting a tilt switch, and the number, shape, and size of rolling members, and they are not excluded from the scope of the present invention.

As described above in detail, the present invention yields the following effects.

[A]

(1) Two elastic contact elements hold therebetween a ball member, which can roll along a path defined between the elastic contact elements, to thereby establish contact with the ball member. As compared to a conventional configuration in which a ball member butts against a contact element through utilization of its own weight to thereby establish contact therebetween, a greater current can flow, and a larger switching capacity can be provided.

(2) Since a tilt switch is configured such that two elastic contact elements hold therebetween a ball member, which can roll along a path defined between the elastic contact elements, to thereby establish contact with the ball member, the tilt switch features a contact operation which is stable and involves little chattering.

(3) By virtue of simple and compact structure, a tilt switch can be inexpensive and robust.

(4) Since a restriction wall is employed in order to maintain a constant distance between free-end portions of contact elements, dimensional variations in bending process of the contact elements can be absorbed to thereby maintain a stable pressure of contact. Thus, a tilt switch of uniform and good quality can be provided.

(5) Since a restriction wall is employed in order to maintain a constant distance between free-end portions of contact elements, the contact elements can hold a ball member therebetween under a constant load. Thus, the ball member can roll smoothly.

(6) Since contact elements can each be formed of a wire, a resistive force against movement of a ball member is reduced. Furthermore, since a restriction wall assumes the form of a pair of recess portions or protrusions for guiding the corresponding free-end portions of the contact elements, a tilt switch of good sensitivity to tilting can be provided.

(7) A groove portion is formed on the bottom of a base such that the bottom of the groove portion assumes the form of a slope ascending in opposite directions from a central portion thereof. A magnet is disposed so as to hold a ball member at the central portion. Thus, when a tilt switch is in a horizontal position, the ball member can be held stably at the central portion.

(8) A ball member can move in every direction to thereby detect tilting of a tilt switch in every direction. Also, when the tilt switch is in a horizontal position, the ball member can be held reliably at the central position of the tilt switch.

[B]

(1) A tilt switch includes a housing having a hollow portion; at least one rolling member disposed in such a manner as to roll substantially linearly within the hollow portion; and a contact mechanism accommodation portion disposed side by side with the hollow portion. A movable contact element and a stationary contact element are accommodated within the contact mechanism accommodation portion and disposed in a facing manner. Each of the movable contact element and the stationary contact element is formed of a spring element. A working member having a pivot formed thereon is disposed in such a manner as to rotate as a result of movement of the rolling member and such that a portion thereof projects into the hollow portion. The working member rotates and presses the movable contact element to thereby bring the movable contact element in contact with the stationary contact element. Thus, a force of contact which is far greater than the weight of the rolling member can be produced, whereby stable contact can be maintained, and a large switching capacity can be obtained.

(2) A movable contact element and a stationary contact element—which are each formed of a spring element—are accommodated within a contact mechanism accommodation portion—which is disposed side by side with a hollow portion—and disposed in a facing manner. Thus, the contact elements can assume an efficiently long length without need to increase the size of a tilt switch, thereby utilizing effect of moment. Therefore, the tilt switch can provide high contact reliability.

(3) A working member having a pivot formed thereon is disposed in such a manner as to rotate as a result of movement of a rolling member and such that a portion thereof projects into a hollow portion. The working member rotates and presses a movable contact element to thereby bring the movable contact element in contact with a stationary contact element. Thus, a rotation moment which is imposed on the working member by the rolling member is transmitted to the movable contact element without attenuation. Also, the working member can smoothly return to its neutral position when a tilt switch is restored to a horizontal position.

(4) A stationary contact element is supported at a predetermined position by a stopper portion so as to maintain a predetermined distance away from a movable contact element. Thus, dimensional variations in bending process of the stationary contact element can be absorbed, whereby a tilt switch of good accuracy of operation can be provided.

(5) Since a working member projects into a hollow portion while forming an obtuse angle with respect to a side wall of the hollow portion, a tilt switch can exhibit reliable operation characteristics even when a rolling member is light.

(6) A plurality of rolling members are disposed while being connected rotatably by use of connection means. Thus, the total of components of force directed in a moving direction of all the rolling members can be transmitted to a working member. Thus, as compared with the case in which the rolling members are not connected, the size of a tilt switch can be rendered more compact. Also, connection between contacts can be opened and closed more reliably, and the force of contact can be enhanced.

What is claimed is:

1. A tilt switch comprising:

a pair of wire contact elements having movable free ends approaching each other, at least one of said contact elements being elastic; and a wall with a pair of recesses or protrusions for restricting movement of said free ends of said contact elements to maintain at least a predetermined distance between said free ends;

at least one ball member which rolls along a path defined between said contact elements, wherein said contact elements are disposed facing each other with a distance therebetween as measured at one end greater than a diameter of said ball member and a distance therebetween as measured at the other end slightly smaller than the diameter of said ball member;

wherein tilting of said tilt switch is electrically detected through detection of whether or not said ball member is held between said contact elements; and tilting of said tilt switch causes a load connected to said contact elements to be switched on or off.

2. A tilt switch according to claim 1, wherein said ball member is electrically conductive.

3. A tilt switch according to claim 1, wherein said wall is electrically conductive, and said ball member is insulative.

4. A tilt switch comprising:

a base;

at least one ball member which rolls along a path defined in said base;

a magnet for holding said ball member in a central portion of said path when said tilt switch is in a horizontal position;

a pair of contact elements disposed at opposite sides of the central portion to provide a switching operation upon tilting of said tilt switch to either side, at least one of said contact elements being elastic; and wherein said contact elements are disposed facing each other with a distance therebetween, as measured at one end, greater than a diameter of said ball member and a distance therebetween, as measured at the other end, slightly smaller than the diameter of said ball member; and wherein tilting of said tilt switch is electrically detected through detection of whether or not said ball member is held between said contact elements.

5. A tilt switch according to claim 4, wherein a groove portion is formed on a bottom of said base such that a bottom of the groove portion assumes the form of a slope ascending in opposite directions from a central portion thereof.

* * * * *